US008500459B2

(12) United States Patent
Niitsu

(10) Patent No.: US 8,500,459 B2
(45) Date of Patent: Aug. 6, 2013

(54) RECEPTACLE WITH A CAVITY FOR RECEIVING A PLUG WITH A RECESS FOR RECEIVING A COMPONENT

(75) Inventor: Toshihiro Niitsu, Machida (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/121,855

(22) PCT Filed: Sep. 30, 2009

(86) PCT No.: PCT/US2009/059136

§ 371 (c)(1),
(2), (4) Date: Jun. 10, 2011

(87) PCT Pub. No.: WO2010/039904

PCT Pub. Date: Apr. 8, 2010

(65) Prior Publication Data

US 2011/0244734 A1 Oct. 6, 2011

(30) Foreign Application Priority Data

Sep. 30, 2008 (JP) ..... 2008-255658

(51) Int. Cl.
*H01R 12/00* (2006.01)

(52) U.S. Cl.
USPC ..... 439/74

(58) Field of Classification Search
USPC ..... 439/74, 682, 65, 66, 70, 71, 660
See application file for complete search history.

(56) References Cited

U.S. PATENT DOCUMENTS

| | | | | |
|---|---|---|---|---|
| 5,700,151 | A * | 12/1997 | Korsunsky et al. | 439/74 |
| 5,904,581 | A * | 5/1999 | Pope et al. | 439/74 |
| 6,250,935 | B1 * | 6/2001 | Mochizuki et al. | 439/74 |
| 6,983,670 | B2 * | 1/2006 | Kor | 74/490.08 |
| 7,320,606 | B2 * | 1/2008 | Midorikawa | 439/74 |
| 7,344,387 | B2 * | 3/2008 | Shiroyama | 439/74 |
| 7,390,196 | B2 * | 6/2008 | Sasaki | 439/74 |
| 2005/0009383 | A1 | 1/2005 | Okura et al. | |
| 2007/0264854 | A1 | 11/2007 | Sasaki | |
| 2007/0281519 | A1 | 12/2007 | Shiroyama | |

FOREIGN PATENT DOCUMENTS

EP 1 746 688 A2 1/2007

OTHER PUBLICATIONS

International Search Report for PCT/US2009/059136.

* cited by examiner

*Primary Examiner* — Chandrika Prasad
(74) *Attorney, Agent, or Firm* — Timothy M. Morella

(57) ABSTRACT

An electrical connector is provided with a plug portion having an upper surface on which electronic components can be disposed, and a receptacle portion for mounting on a circuit board. In the plug portion, a central recess is formed, which extends downwardly within the body of the receptacle portion so that the electronic components are disposed at least partially within the central recess. The plug portion has, on its lower surface side, plug side contacts that serve as electrical contacts with a terminal of the receptacle portion, and has a protruding portion for engaging the connector receptacle portion. The plug side contacts and the protruding portion are positioned outside of the central recess higher than a bottom plate portion which forms a bottom of the central recess.

20 Claims, 14 Drawing Sheets

RECEPTACLE WITH A CAVITY FOR RECEIVING A PLUG WITH A RECESS FOR RECEIVING A COMPONENT

BACKGROUND OF THE INVENTION

The present invention relates generally to a connector for connecting an electronic component to a circuit board or for connecting two circuit boards with each other, and more particularly, to technology for reducing the height of a connector and one component to which it is connected.

Conventionally, a connector for connecting an electronic component disposed on a circuit board to a second circuit board, and for connecting two circuit boards facing each other, has been used. As an example, Japanese Patent Application No. 2006-310026 A1 discloses a connector for retaining a camera module and for connecting the image sensor of the camera module to a second circuit board. A plate-shaped base is provided in the bottom portion of the camera module, and the image sensor is disposed on the base. A conductor contacting the image sensor is formed on the bottom of the base. The connector has an open recess and terminals in its bottom portion. When the camera module is fitted in the connector from above, the bottom conductors of the base are brought into contact with the terminals of the connector.

Further, in this prior art connector, in order to prevent the camera module from becoming detached from the connector, an engagement portion is provided on an upper edge of the side wall portion of the connector which surrounds the camera module and hooks to the upper edge of the camera module. It is difficult to reduce this style of camera module connector which has a wall portion provided with the engagement portion for retaining the upper portion of an electronic device such as a camera module.

The bottom portion of this connector and the base of the camera module have a flat plate shape, and the terminals and the conductor are positioned between the bottom portion of the connector and the base of the camera module. Therefore, it is difficult to lower the position of the image sensor disposed on the base of the module. As a result, it is difficult to reduce the height of the entire apparatus including the circuit board and the camera module having the built-in sensor, as well as the overall device in which the camera module is accommodated.

The present invention is directed to a connector, particularly one for use with a camera module which overcomes the above-mentioned problem.

SUMMARY OF THE INVENTION

It is therefore a general object of the present invention to provide a connector that enables a reduction in the height of the entire apparatus on which the connector is mounted.

In order to solve the above-mentioned problems, a connector assembly includes a plug portion having plug contacts disposed on a lower surface thereof, and formed so that an electronic component may be disposed on an upper surface thereof. The connector; assembly includes a receptacle portion that is mateable to the plug portion and which is oriented to face the plug portion lower surface, the receptacle portion having receptacle contacts provided in opposition to the plug contacts so as to contact them when the plug and receptacle portions are mated together. The plug portion has a recess disposed in an upper surface side which accommodates the electronic component therewithin and the plug portion having attachment means disposed on the lower surface for attaching to the receptacle portion. The plug contacts and the attachment means are provided on the lower surface of the plug portion and are positioned outside of the recess and positioned higher than a bottom plate portion which forms a floor, or bottom, of the recess.

The attachment means in the form of a portion is positioned on the plug portion lower surface and thus with this structure, it is possible to reduce the height of the connector compared with the conventional connector with wall portions surrounding the electronic device and which are provided with engagement portions for retaining the device. Furthermore, the plug portion is formed with a hollow recess in which the electronic components can be disposed, and the plug side contacts and the attachment portion are positioned on the outside of the recess and higher that the floor or bottom of the recess. With this structure, it is becomes possible to lower the position of the electronic components compared with those in the conventional connector in which the terminals and the contacts are positioned between the flat plate-like member on which the electronic components are disposed and the flat bottom portion of the connector. As a result, it is possible to reduce the height of the entire apparatus including the circuit board and the electronic components disposed thereon. In this regard, the electronic components disposed on the inside of the plug portion recess are, for example, a built-in image sensor and an integrated circuit of a camera module, an integrated circuit disposed on a circuit board, and various electronic elements.

The plug portion may have an upper plate, or surrounding skirt portion which expands from an upper edge of the recess to an edge of the plug, and the plug contacts may be positioned on a lower surface side of the upper plate portion. Still further, the attachment portion may be positioned on the lower surface side of the upper plate portion.

The receptacle portion may have a frame-like shape which surrounds the plug member and any sidewalls defining the plug portion recess, and faces the lower surface of the upper plate portion. According to this aspect, it is possible to further lower the position of the bottom plate portion of the recess, to thereby further lower the position of the electronic components disposed on the inside of the recess.

The receptacle is formed with a central cavity in which the plug portion recess extends. According to this aspect, it is possible to further lower the position of the bottom plate portion of the recess, to thereby further lower the position of any electronic components disposed on the inside of the recess. In addition, in this aspect, the receptacle portion cavity extends through the receptacle portion vertically. According to this aspect, it is possible to further lower the position of the electronic components disposed inside of the recess.

Yet further, the receptacle portion may be provided with an attached portion to which the attachment portion of the plug portion is attached, and the attached portion and the attachment portion may respectively have a recessed shape and a protruding shape so as to be engaged with each other. According to this aspect, it is possible to engage the plug and receptacle portions with each other with a simple structure. In addition, in this aspect, the attachment portion of the plug portion may be a protruding portion which protrudes downward from the lower surface of the upper plate portion, the protruding portion having an outer surface provided with the plug side contacts, and the attached portion of the receptacle may be a recessed portion with which the attachment portion of the plug portion is engaged, the receptacle side contact being positioned on the inside of the recess. According to this aspect, it is possible to downsize the electrical connector compared with the case where the plug side contacts are provided at the position separated from the attachment portion.

These and other objects, advantages and features of the invention shall become more evident in a reading of the following detailed description.

BRIEF DESCRIPTION OF THE DRAWINGS

Throughout the course of the following detailed description, reference will be made to the following drawings in which like reference numbers identify like parts and in which.

DETAILED DESCRIPTION OF THE PREFERRED EMBODIMENT

Figure 1:
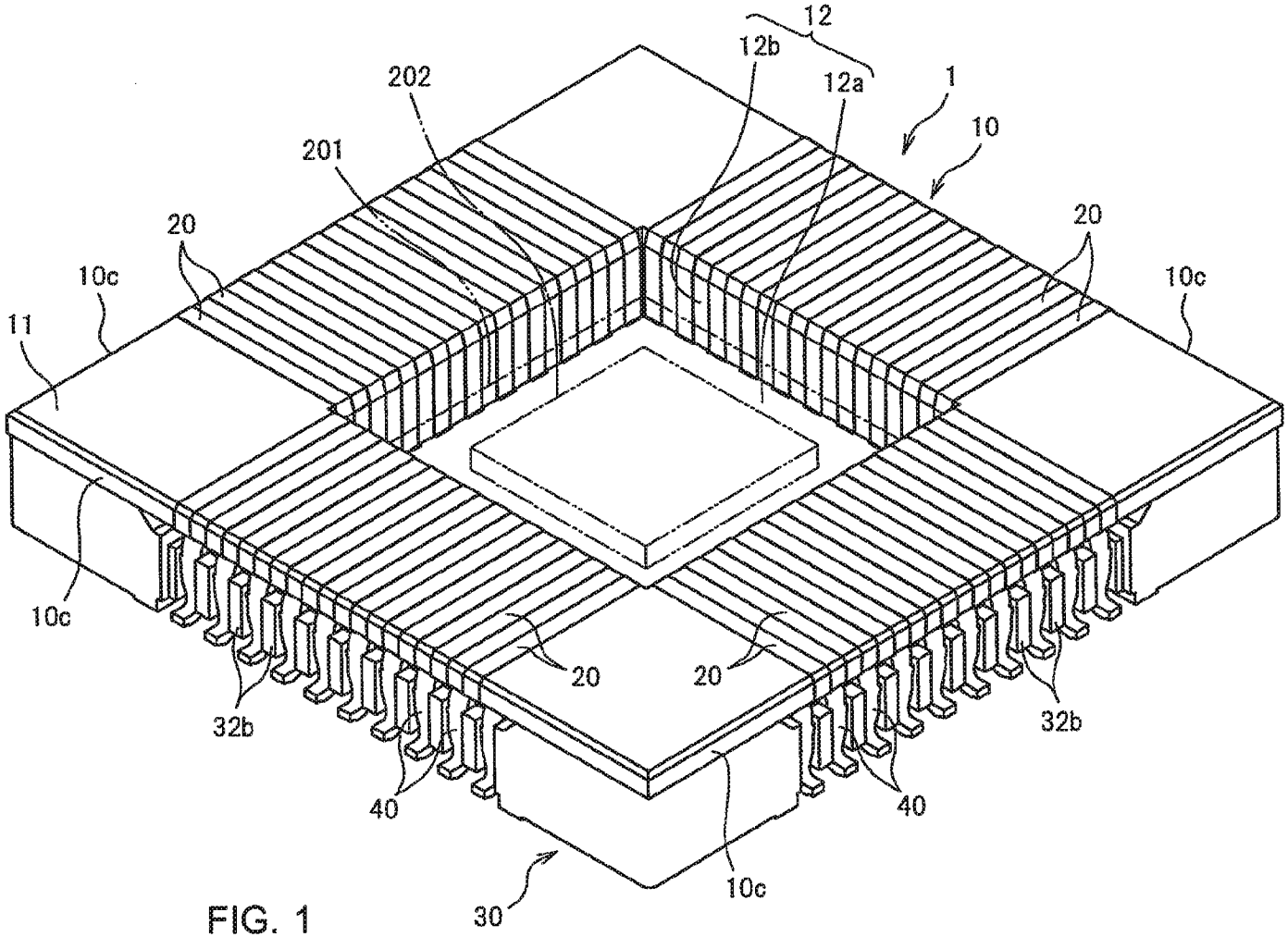
FIG. 1 is a perspective view of an electrical connector according to an embodiment of the present invention.
Figure 2:
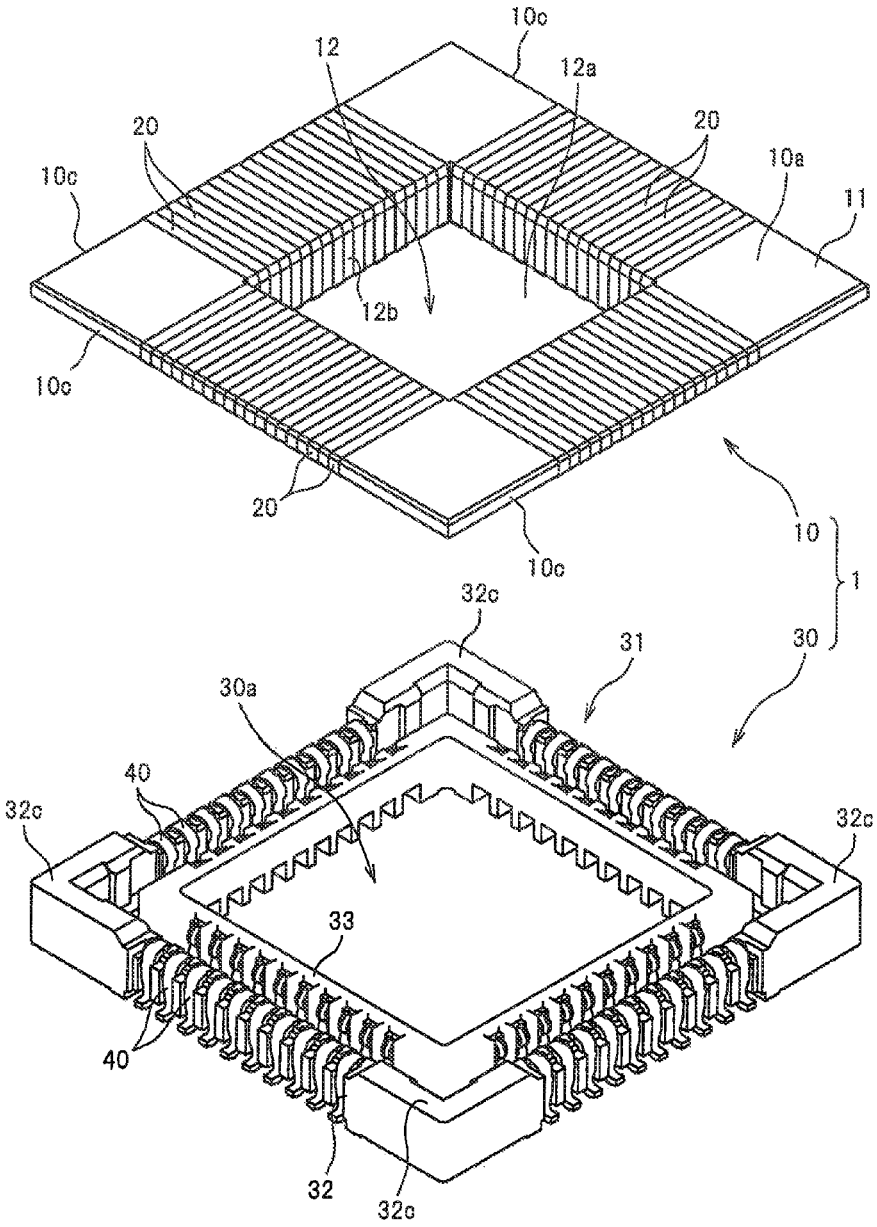
FIG. 2 is an exploded perspective view of the connector of FIG. 1.
Figure 3:
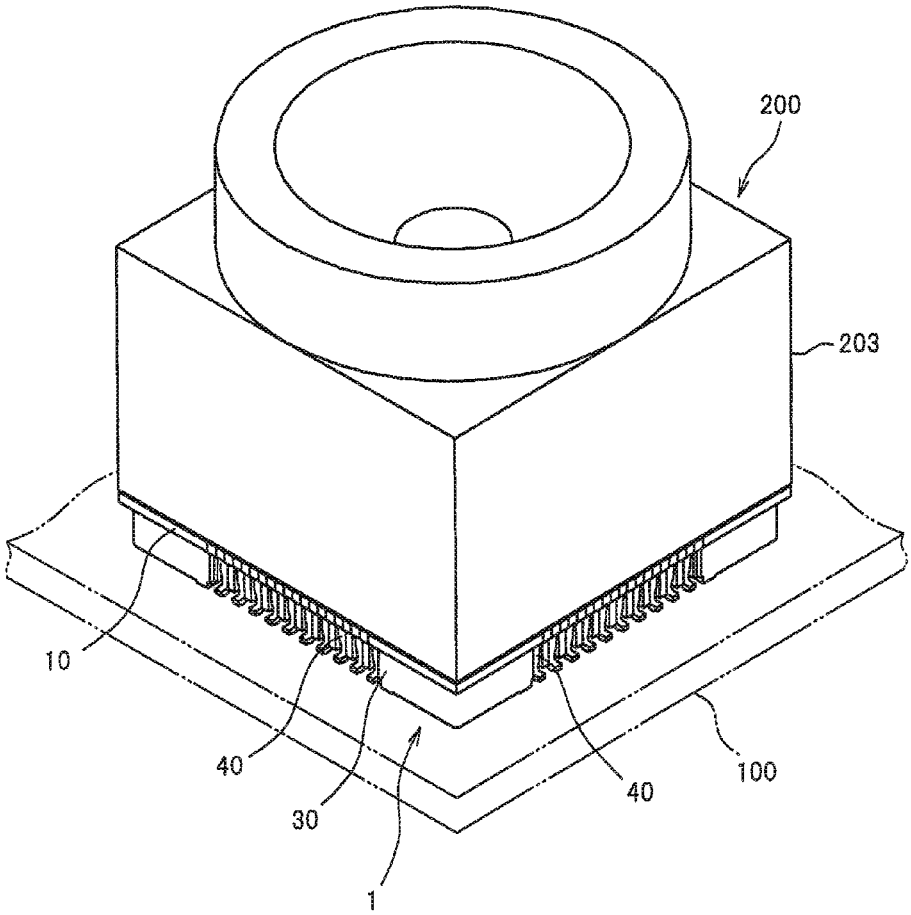
FIG. 3 is a perspective view illustrating a camera module, as an example of an electronic apparatus, disposed on an upper surface side of the connector of FIG. 1, which in turn, is disposed on a circuit board.
Figure 4:
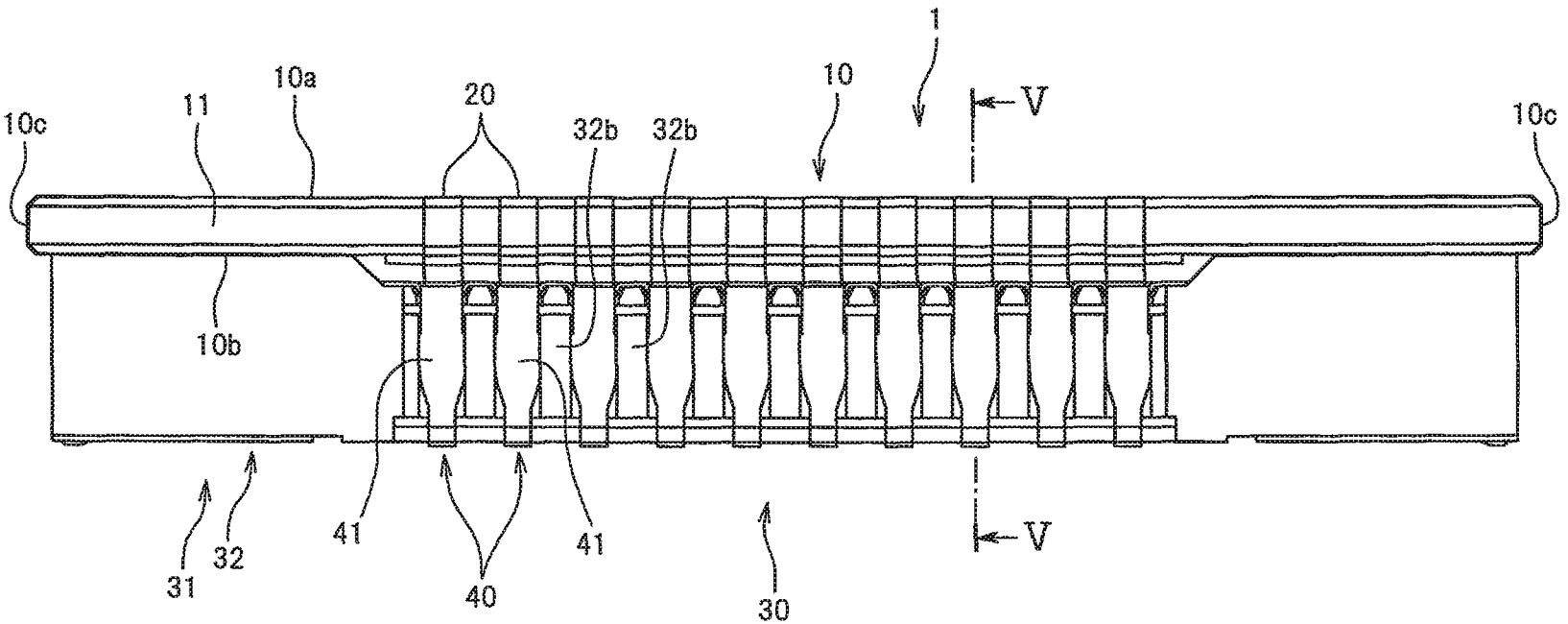
FIG. 4 is a front view of the connector of FIG. 1.

In the following, an embodiment of the present invention is described with reference to the drawings. A connector is shown in FIG. 1 for connecting a built-in circuit board 201 of a camera module 200 to a circuit board 100 or a surrounding electronic device, such as a mobile telephone or the like. The electrical connector 1 includes a plug portion 10 to which the camera module 200 is attached. The electrical connector 1 includes a receptacle portion 30 which is attached to the circuit board 100, and the receptacle portion 30 is disposed so as to face a lower surface 10*b* of the plug portion 10 (FIGS. 1 & 2).

Figure 5:
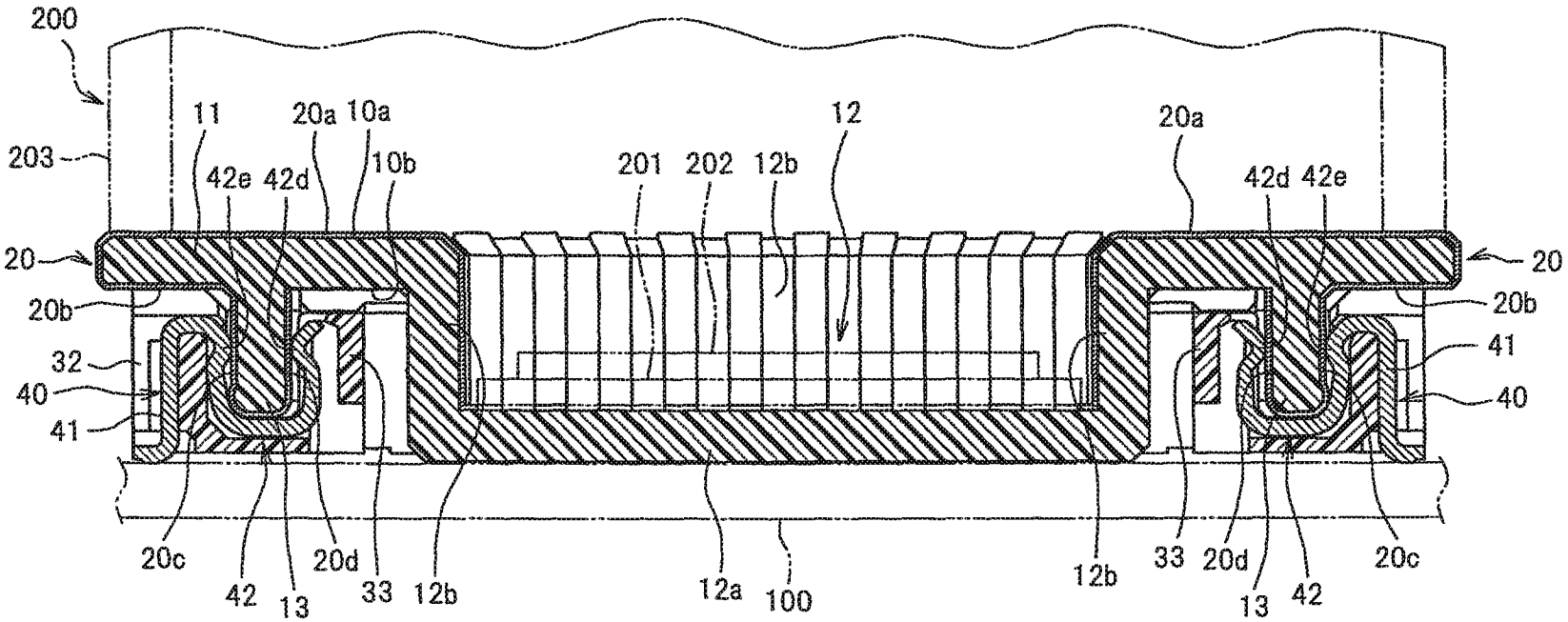
FIG. 5 is a sectional view of the connector of FIG. 4, taken along line V-V thereof.

The plug portion 10 is a plate-like member formed through molding of an insulative resin, and has a quadrangular shape in plan view. In particular, the plug portion 10 shown is square in plan view. As illustrated in FIG. 5, the camera module 200 is disposed on the upper surface 10*a* of the plug portion 10. A housing 203 of the camera module 200 is attached to the upper surface 10*a* of the plug portion 10 by an adhesive, for example. The width of the plug portion 10 is substantially equal to the width of the housing 203 of the camera module 200.

As illustrated in FIGS. 5-9, a recess 12 is formed in the plug portion and it extends downwardly. The plug portion 10 has a flat bottom plate portion 12*a* that forms the bottom, or floor of the recess 12 and further has a continuous sidewall portion 12*b* which extends vertically from the edge of the bottom plate portion 12*a* so as to define a surrounding wall of the recess 12. In this example, four sidewall portions 12*b* are joined together to make a continuous sidewall 12*b* because the bottom plate portion 12*a* is square. The plug portion 10 has an upper plate, or surrounding skirt portion 11 which extends laterally (sideways) from the upper edge of the recess 12 to the edge 10*c* of the plug portion 10.

Electronic components are disposed on the inside of the recess 12. In this example, the built-in circuit board 201 of the camera module 200 is disposed on the bottom plate portion 12*a*, and an image sensor 202 on the circuit board 201 and multiple integrated circuits (not shown) are disposed together with the circuit board 201 on the inside of the recess 12. Further, the camera module 200 has a lens (not shown) for gathering the light incident from the outside onto the image sensor 202. The lens is positioned above the image sensor 202 while being separated from the image sensor 202 by the focal distance of the lens. In this particular embodiment, the bottom plate portion 12*a* is formed square shape to conform to the shape of the camera module circuit board 201. However, the bottom plate portion 12*a* may be formed in a rectangular shape, a circular shape, or any suitable shape in conformity with the shape of the electronic component which is received within the plug portion recess 12. The plug portion recess 12 may include conductive contacts 50 disposed therein in opposition to like contacts on the electronic device and contact may be effected by way of soldering or other suitable means.

Figure 8:
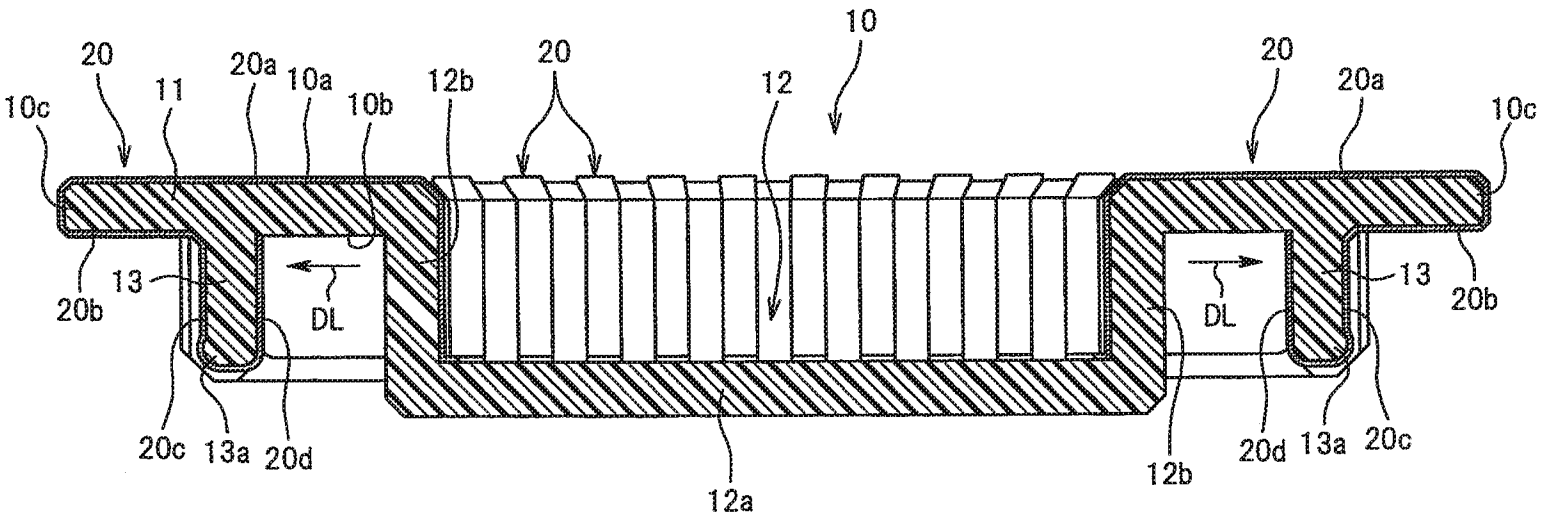
FIG. 8 is a sectional view of the plug portion of FIG. 7, taken along line VIII-VIII thereof.
Figure 9:
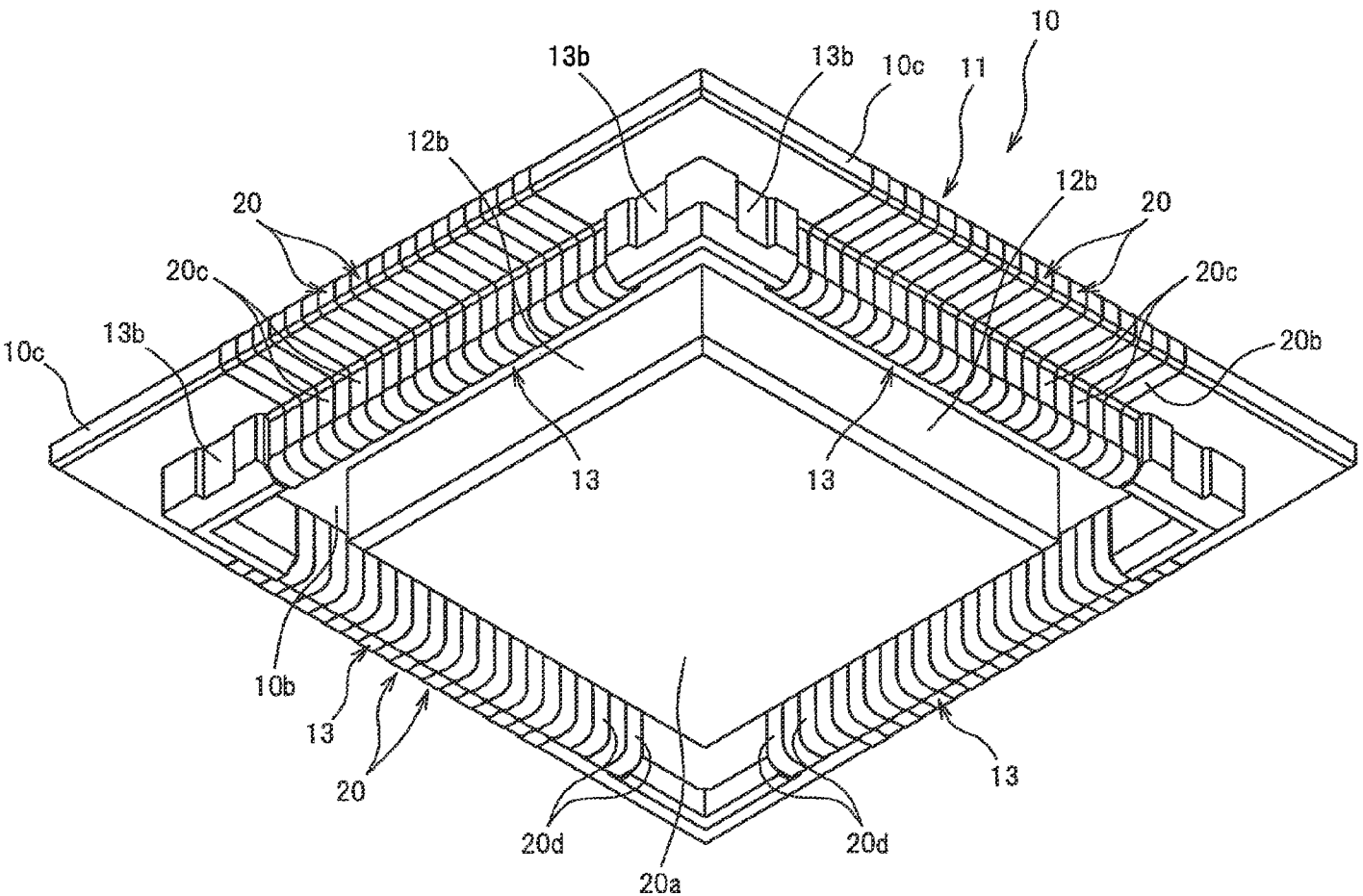
FIG. 9 is a perspective view of the plug portion, seen from underneath and at an angle thereto.

As illustrated in FIGS. 8 and 9, the plug portion 10 has multiple (four in this case) attachment 13 projecting downwardly its lower surface 10*b*, which are received and engaged by the receptacle portion 30. The attachment members 13 project downward from the lower surface of the upper plate portion 11, and are positioned on the outside of the recess 12 and positioned at a level higher than the bottom plate portion 12*a* of the recess 12. The attachment members 13 are positioned spaced from and within the base of which may match the outer edge 10*c* of the plug portion 10, and are positioned below the camera module 200. Further, each attachment members 13 is spaced from (in the direction indicated by arrow DL of FIG. 8) the side wall portion 12*b* of the recess 12, and is preferably arranged parallel to the side wall portion 12*b*. Each attachment member 13 extends alongside a respective sidewall portion and in the embodiment illustrated, the four attachment members 13 are connected to each other to form a continuous attachment member. Pairs of attachment members on opposite sides of the recess 12 may be used for a suitable engagement as well. With this structure, the attachment members 13 form a quadrangular wall which surrounds the sidewall portion 12*b* of the recess. As described later, the attachment members 13 are received in an attachment channel, or groove 34 of the receptacle portion 30, so that the plug portion 10 and the receptacle portion 30 can be mated to each other.

Examples of formation of the plug portion 10 may include a MID (Molded Interconnect Device) in which a contacts or circuits are directly formed on the surface of the molded product by way of plating or the like. As illustrated in FIGS. 1 and 7-9, the upper surface 10*a* and the lower surface 10*b* of the plug portion 10 are shown provided with multiple thin-film contacts, or conductors 20. Specifically, the multiple conductors 20 extend from the inside of the recess 12 to the edges 10*c* of the plug portion 10 on the upper surface of the upper plate portion 11. After that, the conductor 20 is reversed at the edge 10*c* so as to extend from the edge 10*c* to the attachment member 13 on the lower surface of the upper plate portion 11. That is, each of the conductors 20 has an upper conductor 20*a* formed on the upper surface of the upper plate portion 11 and a lower conductor 20*b* formed on the lower surface thereof. As described above, the electronic components, as the circuit board 201, are disposed on the inside of the recess 12, and each of the conductors 20 is connected to the terminal of the electronic components.

Further, the conductor 20 is also formed on the outer surface of the attachment member 13. That is, the conductor 20 has plug side contacts 20*c*, 20*d* extending from the lower conductor 20*b*. The plug side contact 20*c* is formed on the outer surface (surface on edge 10*c* side) of the attachment member 13, and the plug side contact 20*d* is formed on the inner surface (surface facing side wall portion 12*b*) of the attachment member 13. Therefore, similar to the attachment member 13, the plug side contacts 20*c*, 20*d* are positioned on the outside of the recessed 12 (laterally with respect to the side wall portion 12*b*) and positioned higher than the bottom plate portion 12*a*. In this regard, each of the plug side contacts 20*c*, 20*d* serves as an electrical contact with a terminal 40 provided on the receptacle portion 30.

The multiple upper conductors 20*a* of the plug portion 10 extend toward the common outer edge 10*c*, while the lower conductors 20*b* extend from the upper conductors 20*a*. Both such conductors are arranged, at a certain spacings, and preferably parallel. Further, the multiple plug side contacts 20*c*, 20*d* are also arranged preferably parallel similar to the upper conductors 20*a* and the lower conductors 20*b* so as to extend on the outer surfaces of each of the attachment members 13. Therefore, similarly to the attachment member 13, the multiple plug side contacts 20*c*, 20*d* also surround the sidewall portion 12*b* of the recess portion 12.

The receptacle portion 30 has a shape of a quadrangular frame in plan view, and the central portion thereof is formed with a quadrangular cavity 30*a* that extends through the receptacle portion 30 vertically. (FIG. 2) The cavity 30*a* corresponds in size to the bottom plate portion 12*a* of the recess 12, and hence in the state in which the plug portion 10 and the receptacle portion 30 are coupled to each other, the side wall portion 12*b* of the recess 12 is received within the cavity 30*a* (FIG. 5).

Figure 10:
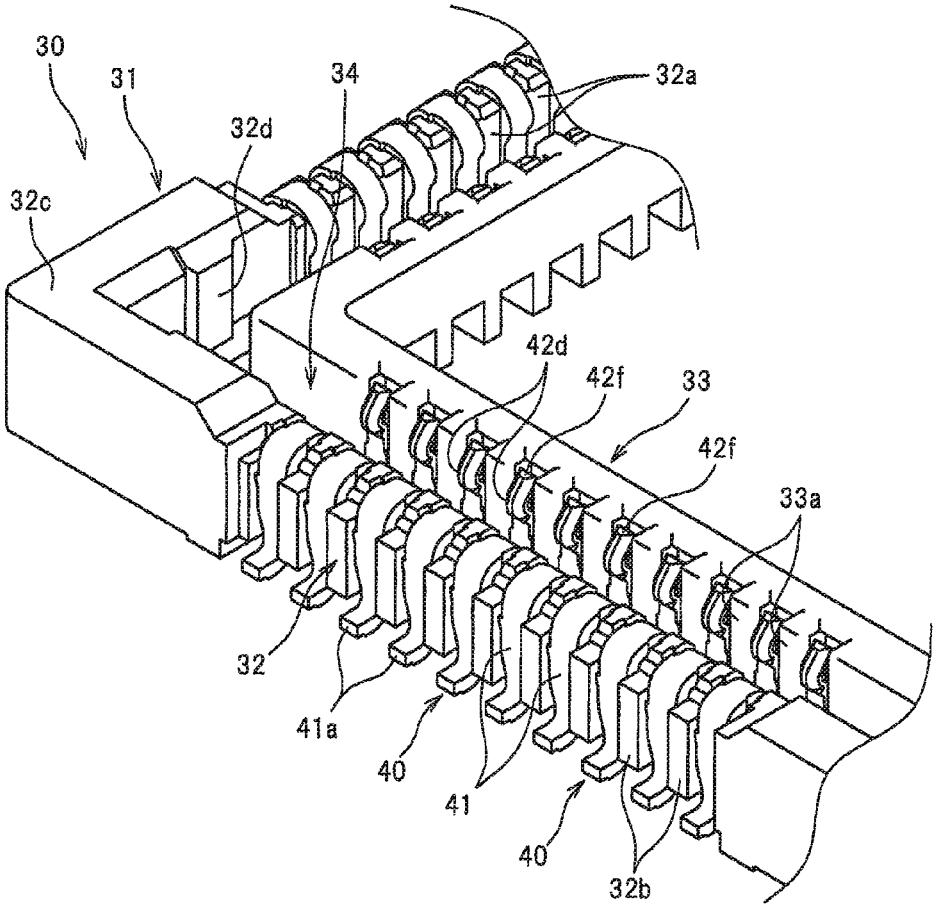
FIG. 10 is an enlarged perspective view of a receptacle portion of the connector of FIG. 1.
Figure 13:
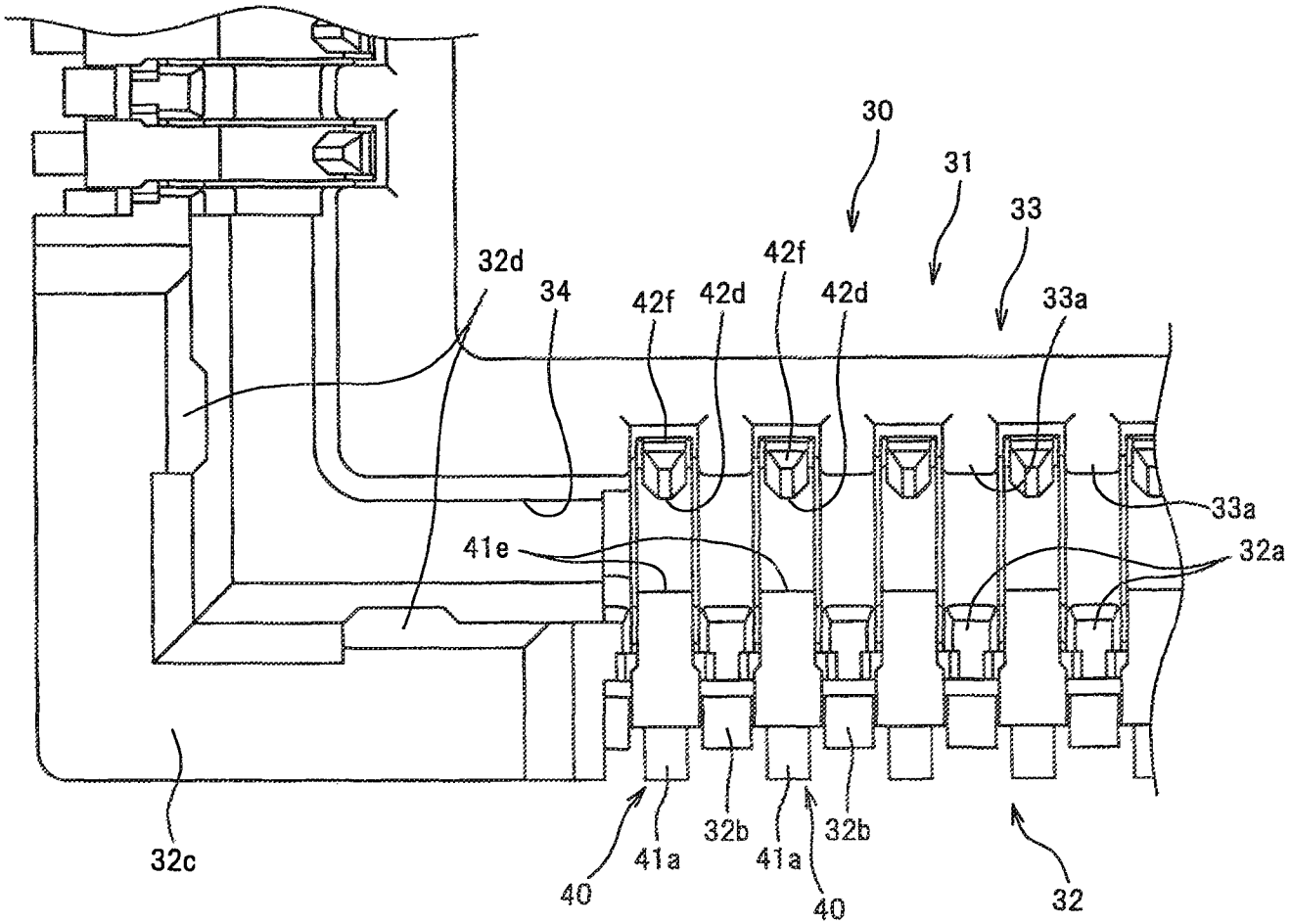
FIG. 13 is an enlarged plan view of the receptacle portion of FIG. 11.

As illustrated in FIGS. 2, 10 & 13, the receptacle portion 30 includes multiple terminals 40 disposed thereon and a frame 31 for retaining the terminals 40. The frame 31 is a quadrangular member formed by molding of an insulating material such as a plastic resin. In the embodiment described herein, the frame 31 has a square shape similar to the bottom plate portion 12*a* of the recess 12. The frame 31 faces, or confronts, the lower surface of the upper plate portion 11 of the plug portion 10 in the vertical, and sides which form the frame 31 are preferably arranged in parallel with the sidewall portions 12*b*. That is, the frame 31 surrounds the sidewall portion 12*b* of the recess 12.

Figure 6:
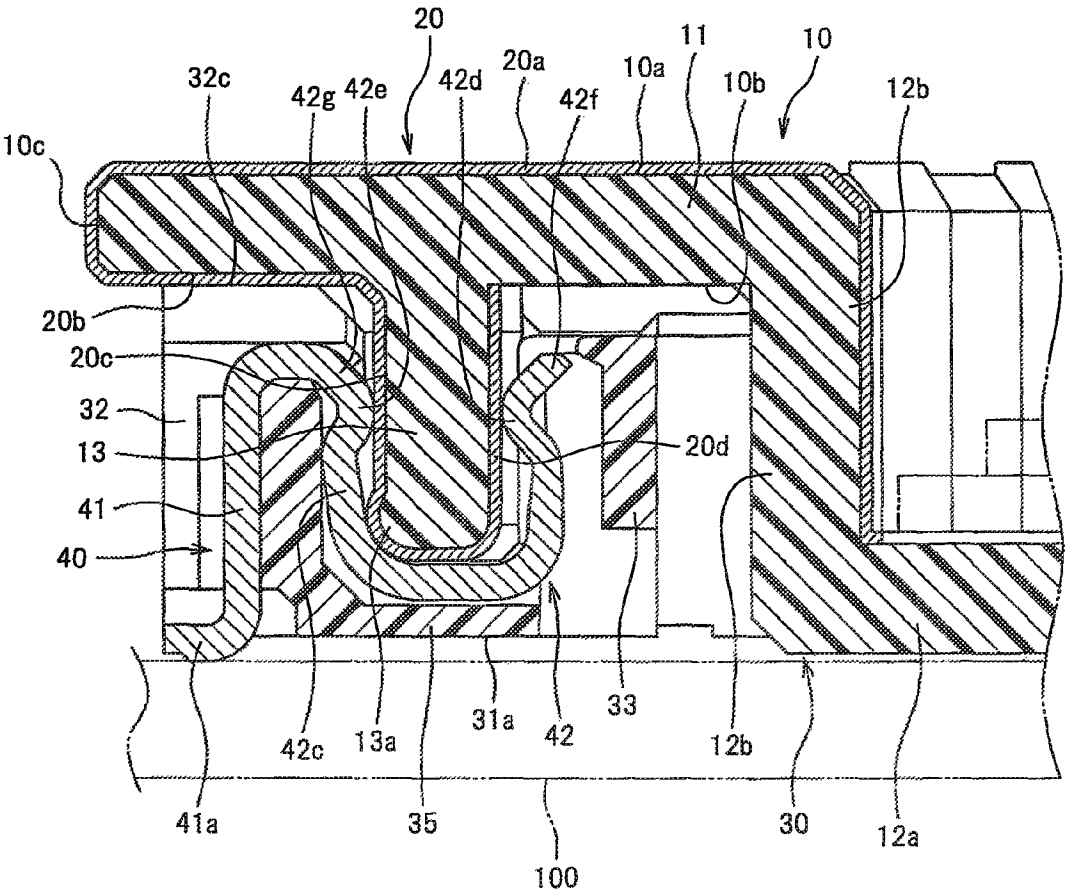
FIG. 6 is an enlarged view of FIG. 5.

As illustrated in FIGS. 5 & 6, the frame 31 has substantially the same height as the side wall portion 12*b* and preferably equal to or slightly greater than it so that the bottom surface of the plug member is ensured of contacting the surface of the circuit board, if desired. Otherwise, in instances where it is desirable to space the bottom of the plug member from the circuit board, the height of the frame and the depth of plug recess may be modified to permit that to occur. Therefore, in the state in which the plug portion 10 and the receptacle portion 30 are mated together, the lower surface of the bottom plate portion 12*a* is positioned at substantially the same height as a lower surface 31*a* of the frame 31, thereby being proximate to the circuit board 100 compared with the upper plate portion 11.

Figure 12:
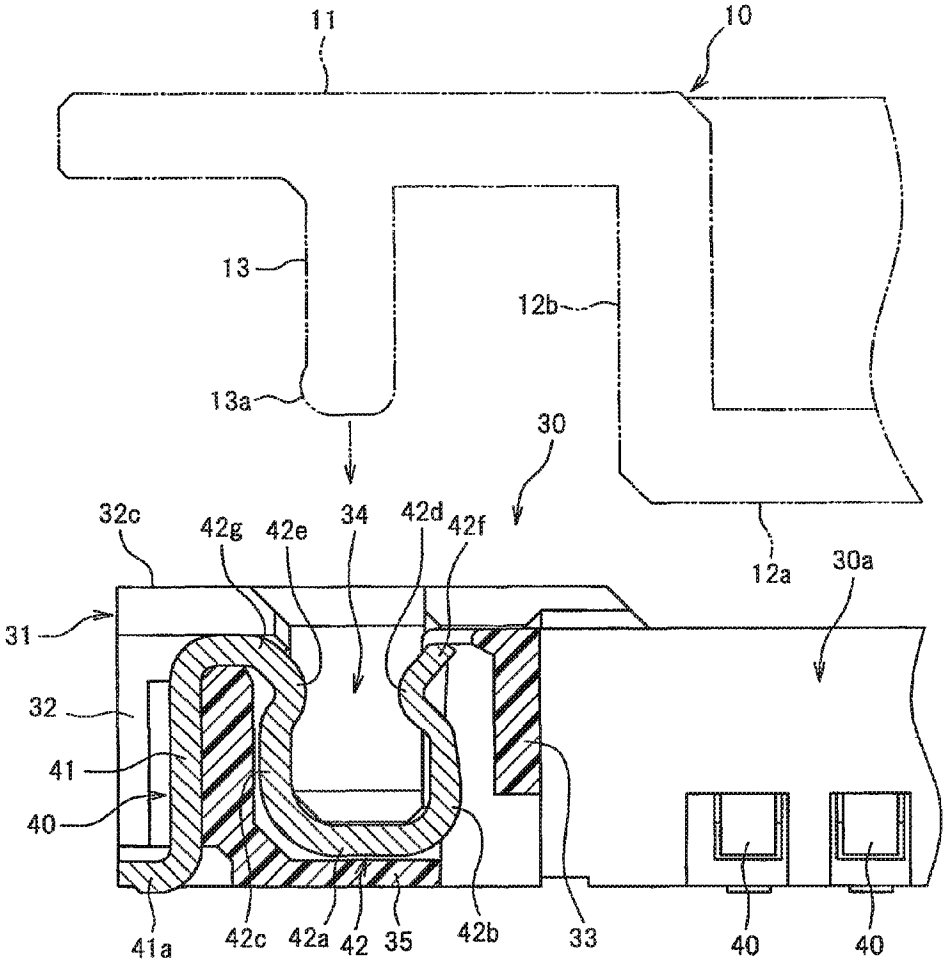
FIG. 12 is a sectional view of the receptacle portion of FIG. 11, taken along line XII-XII thereof.

In the at positions corresponding to the upper surface of the receptacle portion 30 and the lower surface 10*b* of the plug portion 10, there are formed protrusions and recesses having shapes corresponding to each other. As a result of engagement of these protrusions and recesses, the receptacle portion 30 and the plug portion 10 are reliably mated to each other. In this example, as described above, the plug portion 10 has the attachment member(s) 13 which protrude downward from the upper plate portion 11 (refer to FIG. 8). And, as illustrated in FIGS. 10, 12 & 13, the frame 31 is provided with a series of attachment recesses in the form of grooves or channels 34 which open upward toward the lower surface of the upper plate portion 11. The attachment channel 34 extends in the length directions of four sides constituting the quadrangular frame 31. The attachment channel 34 therefore has a quadrangular groove in plan view of the frame 31. That is, the frame 31 has a quadrangular outer frame portion 32 and an inner frame portion 33 positioned on the inside of the outer frame portion 32, which are communicated with each other at bottom portions thereof through intermediation of a bottom portion 35. Therefore, the gap between the outer frame portion 32 and the inner frame portion 33 serves as the attachment channel 34. The position of the attachment channel 34 which has the quadrangular groove corresponds in opposition to the attachment member 13 formed in a quadrangular wall shape, which allows the attachment member 13 to be fitted into the attachment channel 34 from above (FIGS. 5-6).

As described above, the attachment member 13 is positioned outside the recess 12 and at a higher level than the bottom plate portion 12*a* of the recess 12. Therefore, when the plug portion 10 and the receptacle portion 30 are mated to each other, the attachment channel 34 into which the attachment member 13 is received is also positioned outside of the recess 12 and higher than the bottom plate portion 12*a* of the recess 12. That is, the attachment member 13 and the attachment channel 34 are mated to each other below the upper plate portion 11, and laterally coupled to the side wall portion 12*b*.

Figure 11:
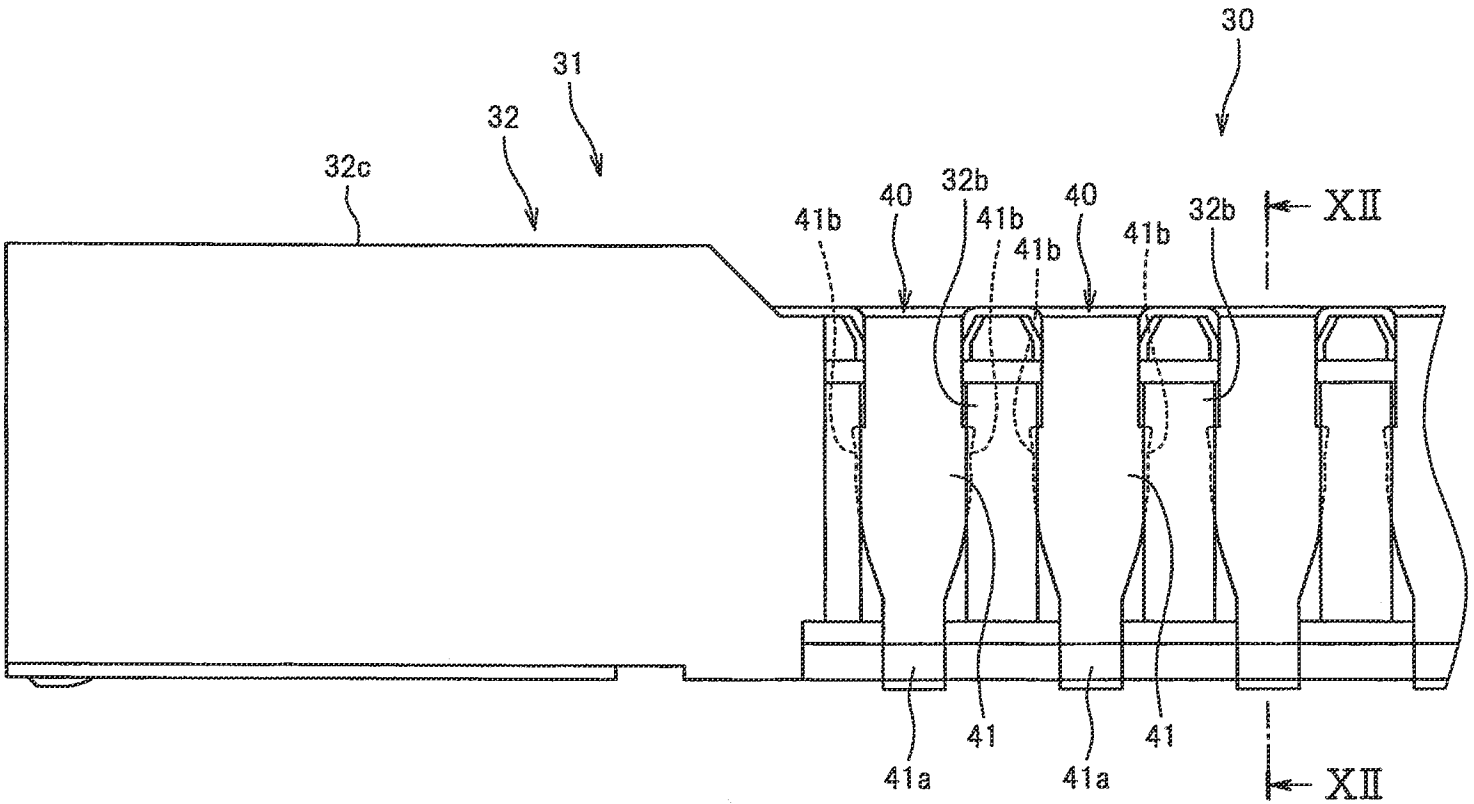
FIG. 11 is an enlarged front view of the receptacle portion of FIG. 10.

The terminal 40 is formed by a spring elastic material. As illustrated in FIGS. 10, 11 & 13, the multiple terminals 40 are arranged at a certain intervals longitudinally of each side of the frame 31. The position of the terminals 40 correspond to the positions of the plug side contacts 20*c*, 20*d*. Therefore, when the plug portion 10 and the receptacle portion 30 are mated to each other, the multiple terminals 40 supported on the frame 31 surround the side wall portions 12*b* of the recess 12.

As illustrated in FIG. 12, the terminals 40 each include a holding portion 42 which fits in the attachment channel 34 and is positioned inside of the attachment channel 34, and leg, or tail, portions 41*a* which extend downward on the outside of the outer frame portion 32. The holding portion 42 opens upward so as to have a substantially U-shape. The leg portions 41 extend downward on the outside of the outer frame portion 32 from one upper end 42*g* of the holding portion 42 beyond the upper edge of the outer frame portion 32. At the lower end of each of the leg portions 41, there is provided a tail portion 41*a* to be soldered to a conductor (not shown) on the circuit board 100. On the outer surface of the outer frame portion 32, there are formed multiple wall portions 32*b* which extend in the up-and-down direction and are arranged at intervals corresponding to the size of the leg portions 41. The leg portions 41 are disposed between the wall portions 32*b*. In this regard, as illustrated in FIG. 11, claw portions 41*b*, hooked to the wall portions 32*b* which sandwich the leg portion 41, are formed on the side surface of each of the leg portions 41, the claw portions 41*b* enabling the terminal 40 to be attached to the frame 31.

The holding portion 42 includes a bottom portion 42*a* disposed on the bottom portion 35 of the frame 31 and a pair of extending portions 42*b*, 42*c* which extend upward from both ends of the bottom portion 42*a*. As illustrated in FIGS. 10, 11 &13, multiple wall portions 32*a*, 33*a* which extend upward are formed on the inner surface of the attachment channel 34 (inner surface of outer frame portion 32 and outer surface of inner frame portion 33). The multiple wall portions 32*a*, 33*a* are arranged at intervals, and the extending portions 42*c*, 42*b* are arranged the wall portions.

As illustrated in FIG. 12, the extending portions 42*b*, 42*c* respectively have a pair of receptacle side contacts 42*d*, 42*e* facing each other on upper portions thereof. The receptacle side contacts 42*d*, 42*e* are formed at positions corresponding to the plug side contacts 20*d*, 20*c*, that is, formed at positions being brought into contact with the plug side contacts 20*d*, 20*c* in the state in which the plug portion 10 and the receptacle portion 30 are coupled to each other. As described above, the plug side contacts 20*d*, 20*c* are positioned laterally to (beside) the side wall portion 12*b* of the recess 12. Therefore, the receptacle side contacts 42*d*, 42*e* and the plug side contacts 20*d*, 20*c* in contact with each other are arranged laterally to (beside) the side wall portion 12*b* in the state in which the plug portion 10 and the receptacle portion 30 are coupled to each other. Further, in this example, the plug side contacts 20*d*, 20*c* are positioned below the camera module 200, and the receptacle side contacts 42*d*, 42*e* and the plug side contacts 20*d*, 20*c* are brought into contact with each other below the camera module 200.

The extending portions 42*b*, 42*c* are curved toward the inside of the attachment channel 34 so that the clearance between the receptacle side contacts 42*d*, 42*e* becomes small. As illustrated in FIG. 13, the receptacle side contact 42*d* protrudes inside of the attachment channel 34 from between the wall portions 33*a* adjacent to the receptacle side contact 42*d*, and the receptacle side contact 42*e* protrudes inside of the attachment channel 34 from between the wall portions 32*a* adjacent to the receptacle side contact 42*e*. The extending portions 42*b*, 42*c* have upper ends (portion above receptacle side contacts 42*d*, 42*e*) 42*f*, 42*g*, respectively, which expand outward so as to have a clearance between them that is larger than the clearance between the receptacle side contacts 42*d*, 42*e*.

The holding portion of the terminals 42 is formed at a position corresponding to the plug side contacts 20*d*, 20*c*. Thus, when the attachment member 13 of the plug portion 10 enters the attachment channel 34, the plug side contacts 20*d*, 20*c* supported on the attachment member 13 are received within the holding portion 42. At this time, the upper ends 42*f*, 42*g* of the extending portions 42*b*, 42*c* expand, and hence the upper ends 42*f*, 42*g* are prevented from colliding against the conductor 20 at the forward end of the attachment member 13. The attachment member 13 and the plug side contacts 20*d*, 20*c* enter and advance to the bottom portion 42*a* of the holding portion 42 until the lower surface of the upper plate portion 11 is brought into contact with the upper surface of the frame 31. In particular, as illustrated in FIG. 2 or FIG. 10, at the four corner portions of the outer frame portion 32, there is formed an uppermost surface 32*c* so as to be slightly higher than a middle portion of the each side of the outer frame portion 32 (portion where terminals 40 are arranged). Thus, until the lower surface of the upper plate portion 11 is brought into contact with the uppermost surface 32*c* of the frame 31, the attachment member 13 enters and advances to the bottom portion 42*a* of the holding portion 42.

Figure 7:
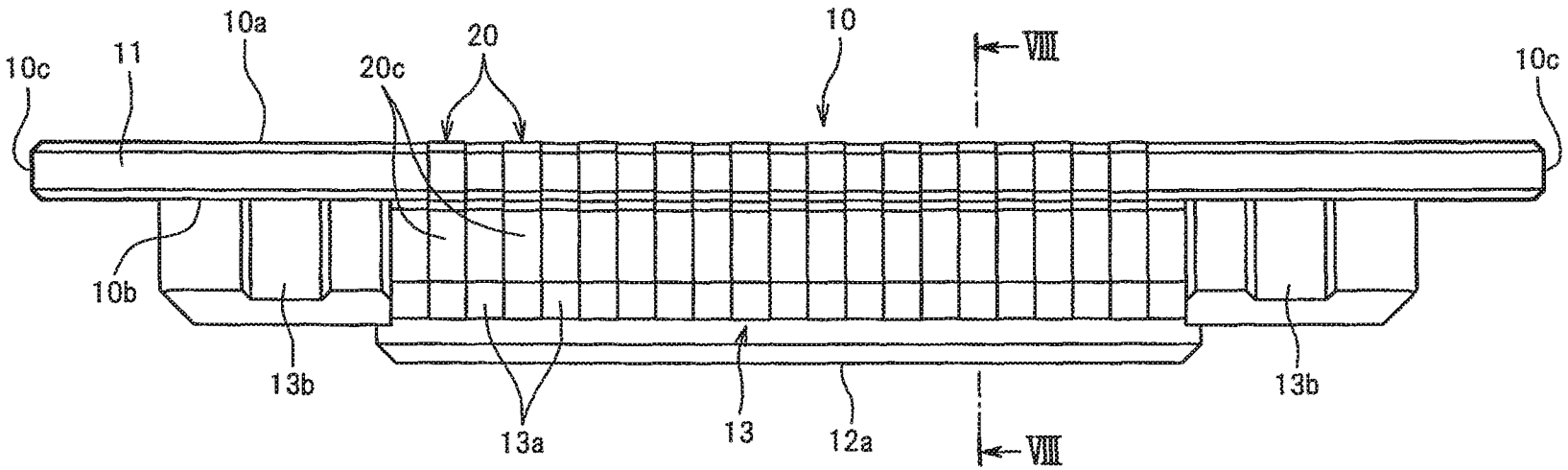
FIG. 7 is a front view of a plug portion of the connector of FIG. 1.

Further, as illustrated in FIGS. 10 & 13, multiple guide portions 32*d* which extend vertically and project outwardly are formed on the inner surface of the outer frame portion 32 and may be considered as within the attachment channels. The guide portions 32*d* assist in providing a good retention force when the two connector portions are engaged and they may also provide a means for polarizing the connector assembly to ensure that the plug portion 10 is inserted in the proper orientation within the receptacle portion 30. Meanwhile, as illustrated in FIGS. 7 & 9, multiple guided grooves 13*b* which extend vertically are formed on corresponding outer surfaces of the attachment members 13. Therefore, when the attachment member 13 enters the attachment channel 34, the guided grooves 13*b* are guided by the guide protruding portions 32*d*.

As illustrated in FIG. 6, when the attachment member 13 is fitted in and attached to the attachment channel 34, the plug side contact 20*c* is brought into contact with the receptacle side contact 42*e*, and the plug side contact 20*d* is brought into contact with the receptacle side contact 42*d*. As a result, the conductor of the circuit board 100 and the circuit board 201 disposed in the recess 12 are electrically connected with each other through intermediation of the conductor 20 and the terminals 40.

As described above, the extending portions 42*b*, 42*c* are curved toward the inside of the attachment channel 34 so that the clearance between the receptacle side contacts 42*d*, 42*e* becomes small. The clearance between the receptacle side contacts 42*d*, 42*e* is smaller than the gap of the attachment channel 34 (clearance between plug side contacts 20*d*, 20*c*) when the holding portion 42 with elasticity is in a free state (state of being free from load). That is, the receptacle side contacts 42*d*, 42*e* are biased to the plug side contacts 20*d*, 20*c* side (inside of attachment channel 34). Thus, in a state in which the plug side contacts 20*d*, 20*c* are positioned on the inside of the holding portion 42, the receptacle side contacts 42*d*, 42*e* are laterally pressed (in a direction orthogonal to the entrance direction of attachment the protruding portion 13) against the plug side contacts 20*d*, 20*c* owing to the elasticity of the holding portion 42. As a result, the plug portion 10 is effectively prevented from being detached from the receptacle portion 30.

Further, the attachment member 13 has, at the forward end thereof, a bulged portion 13*a* which is thicker than the base portion and the mid portion of the attachment member 13. The bulged portion 13*a* bulges in a direction that expands the clearance between the extending portions 42*b*, 42*c*, and has a thickness larger than the clearance between the receptacle side contacts 42*d*, 42*e*. Therefore, after the plug portion 10 is pressed from above and the bulged portion 13*a* expands the clearance between the receptacle side contacts 42*d*, 42*e* so as to enter the inside of the holding portion 42, the plug portion 10 is effectively prevented from being detached from the receptacle portion 30.

In the electrical connector 1 described above, the plug portion 10 has a recess 12 which is recessed downward such that the circuit board 201 and the image sensor 202 can be disposed on the inside of the recessed portion 12 and which bulges downward in the lower surface 10*b* side. The plug portion 10 also has the attachment member 13 which is positioned on the lower surface 10*b* side and attached to the receptacle portion 30. The plug side contacts 20*d*, 20*c* and the attachment member 13 are positioned on the outside of the recess 12 and positioned higher than the bottom plate portion 12*a* which forms the bottom of the recess 12.

In the connector 1 as described above, it will be apparent that the connector can be reduced in size as compared to conventional connectors which have wall portions surrounding the housing of the camera module. Further, the position of the electronic components can be lowered compared with the case where electronic components such as the circuit board 201 and the image sensor 202 are disposed on the upper surface of the flat plate-like member. As a result, it is possible to reduce the height of the entire apparatus including the circuit board and the electronic components disposed thereon. For example, in the camera module 200, it is necessary to dispose the lens above the image sensor 202 while being separated from the image sensor by the focal distance of the lens. Therefore, the image sensor 202 is disposed on the inside of the recess 12, whereby the position of the image sensor 202 can be lowered by the depth of the recess 12, and the position of the lens can be lowered by a height corresponding to the depth. As a result, it is possible to reduce the height of the entire apparatus including the circuit board 100 and the camera module 200.

Further, the receptacle portion 30 is formed with the hole 30*a* in which the side wall portion 12*b* constituting the recessed portion 12 of the plug portion 10 is positioned. With this structure, it is possible to further lower the position of the bottom plate portion 12*a* of the recess 12, to thereby further lower the position of the electronic components disposed on the inside of the recess 12.

Note that the present invention is not limited to the electrical connector 1 described above, and various modifications can be made thereto. For example, the camera module 200 is disposed on the upper surface 10*a* side of the plug portion 10 of the electrical connector 1 in the above description. However, the circuit board may be disposed on the upper surface 10*a* side of the plug portion 10.

Figure 14:
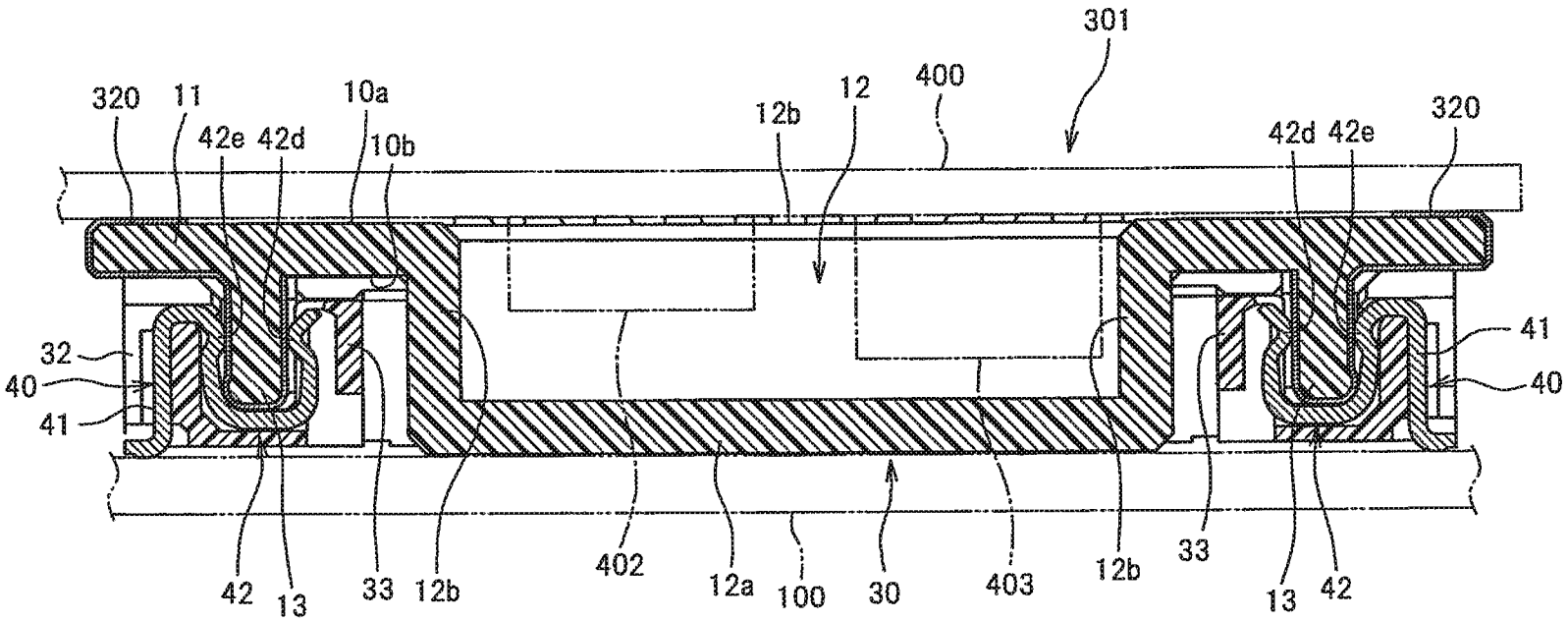
FIG. 14 is a sectional view of another embodiment of a connector according to the invention.

FIG. 14 illustrates an electrical connector of this embodiment, which is a sectional view of an electrical connector 301 interposed between the circuit board 100 and a circuit board 400 for the purpose of electrical connection between the two circuit boards. In FIG. 14, the same parts as those in the above description are denoted by the same reference symbols, and description thereof is omitted.

Similarly to the above-mentioned electrical connector 1, the plug portion 10 of the electrical connector 301 includes the recess 12 and the upper plate portion 11. The conductor 320 is formed on both the upper surface of the upper plate portion 11, which faces the circuit board 400, and on the lower surface of the upper plate portion 11. Similarly to the conductor 20, the conductor 320 is also formed on the outer surface of the attachment member 13 so as to be brought into contact with the terminal 40. The conductor 320 is attached to the conductor formed on the lower surface of the circuit board 400 near the edge 10*c* of the plug portion 10. For example, the conductor 320 is soldered to the conductor of the circuit board 400. Further, in the example illustrated in FIG. 14, the electronic components 402, 403 attached to the lower surface of the circuit board 400 are positioned on the inside of the recess 12. The recess 12 is formed in accordance with the size of the electronic components 402, 403 disposed on the inside thereof.

Further, in the above description, the circuit board 201 is disposed on the bottom plate portion 12*a* of the central recessed portion 12, and the image sensor 202 is disposed thereon. However, the image sensor 202 may be directly mounted to the bottom plate portion 12*a*. With this structure, the position of the image sensor 202 can be further lowered. In this case, the conductor 20 is formed on the bottom plate portion 12*a* in accordance with the position of the terminal of the image sensor 202.

Further, in the case where the image sensor 202 and other electronic components such as an integrated circuit are disposed on the circuit board 201, only the other electronic components are disposed on the circuit board 201, and the image sensor 202 may be directly mounted onto the bottom plate portion 12*a*. In this case, for example, the circuit board 201 may be formed with a hole passing through the circuit board 201, and the image sensor 202 may be positioned on the inside of the hole.

Further, in the above description, the receptacle portion 30 has a frame-like shape, and the interior cavity 30*a* passes through the receptacle portion 30 vertically. However, if desired for a particular application, a recess may be substituted for the cavity 30*a* which passes completely through the receptacle portion 30. In this case, a bottom surface is provided on the inside of the receptacle frame 31, and the bottom plate portion 12*a* of the plug portion recess 12 is positioned on the bottom surface.

Still further, in the above description, the receptacle portion 30 is formed in a shape of a quadrangular frame surrounding the recess 12. However, the shape of the receptacle portion 30 is not thus limited. For example, a shape may be adopted in which one of the four sides constituting the quadrangular shape is omitted.

The center of the plug portion 10 is provided with the recess 12 in which the electronic component is disposed. However, the position of the recessed portion in which the electronic component is disposed is not thus limited. The recessed portion may be provided at any of the edges 10*c* of the plug portion 10 while being biased toward that edge.

Yet further, in the above description, the plug side contacts 20*d*, 20*c* are provided on the outer surface of the attachment member 13 serving as an attachment portion which is attached to the receptacle portion 30. However, the plug side contacts 20*d*, 20*c* and the attachment portion may be provided at positions separately from each other. For example, the side wall portion 12*b* and the receptacle portion 30 may be formed such that the outer surface of the side wall portion 12*b* of the recess 12 serves as an attachment portion to be attached to the receptacle portion 30. Further, the receptacle side contacts 42*d*, 42*e* and the plug side contacts 20*d*, 20*c* may be formed so as to be brought into contact with each other at positions separated from the side wall portion 12*b* in the lateral direction.

Note that, the terms "up" and "down" defined in the above description refer to the directions which represent the positional relationships between the plug portion 10, the receptacle portion 30, and the like, and do not refer to absolute directions.

What is claimed is:

1. A component to a board connector assembly, comprising:

a plug portion, the plug portion including a skirt portion, a recess extending downwardly from the skirt portion for a first preselected depth and being defined by a plate portion and at least one sidewall portion, the plate portion including a mating surface spaced from the skirt portion, and a plurality of conductive plug contacts disposed along the skirt portion; and a receptacle portion mateable with the plug portion, the receptacle portion including a frame defining and enclosing a cavity therein, the cavity having a second preselected depth for receiving the recess therein when the plug and receptacle portions are mated together, and a plurality of conductive receptacle contacts disposed on the frame in opposition to the plug contacts;

wherein the recess receives the component and provides an electrical connection between the component and the board when the plug portion is mated with the receptacle portion.

2. The connector assembly of claim 1, wherein the plate portion defines, on opposite surfaces thereof, a floor of the recess and the mating surface.

3. The connector assembly of claim 1, wherein the plug contacts are arranged on the skirt portion in at least two distinct rows.

4. The connector assembly of claim 1, wherein the plug contacts are arranged on the skirt portion in four distinct rows.

5. The connector assembly of claim 1, wherein the plug portion further includes at least one plug engagement member that depends down from the skirt portion, the plug contacts being disposed along each engagement member.

6. The connector assembly of claim 5, wherein the receptacle portion further includes an engagement channel that receives each engagement member.

7. The connector assembly of claim 6, wherein the plug contacts and the receptacle contacts engage each other to hold the plate portion in place within the cavity so that the mating surface is held against the board to which the receptacle portions are mounted.

8. The connector assembly of claim 7, wherein the first preselected depth is equal to or greater than the second preselected depth.

9. The connector assembly of claim 5, further including a pair of engagement members spaced apart from and generally parallel to each other, disposed on opposite sides of the recess.

10. The connector assembly of claim 1, further including a plurality of engagement members surrounding the plug member.

11. The connector assembly of claim 10, wherein the engagement members are joined together to form a continuous engagement member.

12. The connector assembly of claim 11, wherein the continuous engagement member includes a plurality of engagement portions formed on a surface thereof and spaced apart from each other.

13. A plug connector for engaging an opposing receptacle connector comprising:

a flat skirt portion;

a recess formed in downward alignment with the flat skirt portion and having a preselected depth, the recess being surrounded by the flat skirt portion; and a plurality of contacts, the contacts being disposed on the skirt portion;

wherein the recess receives a portion of an electronic component, while the contacts make contact with opposing contacts of the receptacle connector.

14. The plug connector of claim 13, wherein the recess has a planar mating face spaced away from the flat skirt portion.

15. The plug connector of claim 13, further including at least one pair of attachment members projecting away from the skirt portion and being spaced away from the recess, the contacts being supported along the attachment members.

16. The plug connector of claim 15, further including a plurality of attachment members joined together to form a continuous attachment member that surrounds the recess.

17. The plug connector of claim 13, wherein the contacts are arranged in at least two distinct rows on the flat skirt portion.

18. The plug connector of claim 13, wherein the contacts are arranged in four distinct rows on the skirt portion.

19. A receptacle connector for engaging an opposing plug connector comprising:

a frame portion that surrounds a hollow cavity, the cavity being at least partly defined by the frame portion and having a floor portion extending between portions of the frame portion; and a plurality of conductive contacts being disposed on the frame portion;

wherein the contacts provide an electrical connection between an electronic component, fitted within the plug connector, and mounted on a board when the receptacle connector engages the plug connector.

20. The receptacle connector of claim 19, further including an attachment channel.

* * * * *